US011781087B2

(12) United States Patent
Schlarb et al.

(10) Patent No.: US 11,781,087 B2
(45) Date of Patent: Oct. 10, 2023

(54) LUBRICANT COMPOSITION FOR CLAMPING DEVICES

(71) Applicant: DDP SPECIALTY ELECTRONIC MATERIALS US 9, LLC, Midland, MI (US)

(72) Inventors: Tobias Schlarb, Wiesbaden (DE); Christian Kranenberg, Wiesbaden (DE)

(73) Assignee: DDP SPECIALTY ELECTRONIC MATERIALS US9, LLC, Midland, MI (US)

( * ) Notice: Subject to any disclaimer, the term of this patent is extended or adjusted under 35 U.S.C. 154(b) by 0 days.

(21) Appl. No.: 17/644,901

(22) Filed: Dec. 17, 2021

(65) Prior Publication Data

US 2022/0112441 A1 Apr. 14, 2022

Related U.S. Application Data

(63) Continuation-in-part of application No. 16/954,267, filed as application No. PCT/US2018/063831 on Dec. 4, 2018, now Pat. No. 11,208,609.

(60) Provisional application No. 62/608,595, filed on Dec. 21, 2017.

(51) Int. Cl.

| | |
|---|---|
| ***C10M 169/00*** | (2006.01) |
| ***C10M 129/76*** | (2006.01) |
| ***C10M 103/06*** | (2006.01) |
| ***C10M 101/02*** | (2006.01) |
| ***C10M 117/04*** | (2006.01) |
| ***C10M 143/04*** | (2006.01) |
| ***C10M 143/06*** | (2006.01) |
| ***C10M 159/06*** | (2006.01) |
| ***C10M 161/00*** | (2006.01) |
| ***C10M 111/00*** | (2006.01) |
| *C10N 50/10* | (2006.01) |
| *C10N 20/04* | (2006.01) |
| *C10N 40/22* | (2006.01) |

(52) U.S. Cl.

CPC ..... *C10M 169/00* (2013.01); *C10M 101/02* (2013.01); *C10M 103/06* (2013.01); *C10M 111/00* (2013.01); *C10M 117/04* (2013.01); *C10M 129/76* (2013.01); *C10M 143/04* (2013.01); *C10M 143/06* (2013.01); *C10M 159/06* (2013.01); *C10M 161/00* (2013.01); *C10M 2201/065* (2013.01); *C10M 2201/0623* (2013.01); *C10M 2201/0853* (2013.01); *C10M 2203/1025* (2013.01); *C10M 2205/024* (2013.01); *C10M 2205/026* (2013.01); *C10M 2205/18* (2013.01); *C10M 2207/1265* (2013.01); *C10M 2207/1285* (2013.01); *C10M 2207/288* (2013.01); *C10N 2020/04* (2013.01); *C10N 2040/22* (2013.01); *C10N 2050/10* (2013.01)

(58) Field of Classification Search

CPC ..... C10M 169/06; C10M 2201/062; C10M 2201/081; C10M 2201/085; C10M 2201/1026; C10M 2201/105; C10M 2201/1056; C10M 2203/0206; C10M 2209/084; C10M 2209/1033; C10M 2215/1026; C10M 2229/0415; C10M 2229/0425; C10N 2010/04; C10N 2010/08; C10N 2010/02

See application file for complete search history.

(56) References Cited

U.S. PATENT DOCUMENTS

| | | | | |
|---|---|---|---|---|
| 4,525,286 | A * | 6/1985 | Reick | C10M 177/00 508/181 |
| 5,000,862 | A | 3/1991 | Waynick | |
| 5,102,565 | A | 4/1992 | Waynick | |
| 6,420,035 | B1 | 7/2002 | Amano et al. | |
| 2004/0127616 | A1 | 7/2004 | Wentworth et al. | |
| 2008/0011776 | A1 | 1/2008 | Patel et al. | |
| 2009/0221457 | A1 * | 9/2009 | Ikezawa | C10M 141/02 508/162 |
| 2010/0264649 | A1 | 10/2010 | Goto et al. | |
| 2018/0066200 | A1 * | 3/2018 | Scherer | C10M 101/02 |

FOREIGN PATENT DOCUMENTS

| | | | |
|---|---|---|---|
| CN | 102433195 | A | 5/2012 |
| EP | 1045020 | A1 | 10/2000 |
| JP | 2003013083 | A | 1/2003 |
| JP | 2008075036 | A | 4/2008 |
| JP | 2012224834 | A | 11/2012 |

OTHER PUBLICATIONS

China National Intellectual Property Administration: Search Report for 201880079812.6 Application with an Examiner dated Oct. 15, 2021.

International Search Report of the International Searching Authority for PCT/US2018/063831 dated Mar. 25, 2019.

* cited by examiner

*Primary Examiner* — Vishal V Vasisth

(74) *Attorney, Agent, or Firm* — Lorenz & Kopf, LLP

(57) ABSTRACT

A lubricating composition which, when used with a device for clamping an article, such as a chuck, produces excellent lubricating properties whilst remaining strongly adhered to metal parts in a clamping mechanism of the device and showing enhanced chemical and physical resistance to fluids such as cutting fluids.

20 Claims, No Drawings

LUBRICANT COMPOSITION FOR CLAMPING DEVICES

CROSS-REFERENCE TO RELATED APPLICATIONS

This is a continuation in part of U.S. application Ser. No. 16/954,267, filed on Jun. 16, 2020, now U.S. Pat. No. 11,208,609, which was the U.S. National-Stage entry under 35 U.S.C. § 371 based on International Application No. PCT/US2018/063831, filed on Dec. 4, 2018, which claims the benefit of U.S. Provisional Application No. 62/608,595 filed on Dec. 21, 2017, each of the disclosures of which are hereby expressly incorporated herein by reference in their entirety.

TECHNICAL FIELD

The present disclosure relates to a lubricating grease composition, and more specifically, to a lubricating grease composition which, when used with an article clamping device produces excellent lubricating properties whilst remaining strongly adhered to metal parts in the clamping mechanism of the device and showing enhanced chemical and physical resistance to fluids such as cutting fluids with which they come into contact.

BACKGROUND

Article clamping devices are well known in the art for various applications. They include, for the sake of example chuck devices (both keyed and keyless) which are used to hold tools with radial symmetry in e.g. drills and mills or for clamping rotating workpieces in lathes and the like. Other clamping devices include collet devices which generally are used in situations where a collar around an article to be held is required and exerts a strong clamping force on the object as it is tightened, usually by means of a tapered outer collar. For the sake of this disclosure article clamping devices may also be considered to include fastening devices or mechanisms for attaching grinding discs, saw blades, and the like to drive spindles. These fastening devices may include conventional nuts, torque enhancing nuts, or similar mechanisms.

Many of these devices, such as keyed and keyless chucks and collets, work on a principle of sliding frictional engagement of actuation members to cause engaging members to grip a tool held in the device. Hence, frictional interfaces are operationally unavoidable and as might be expected are a, if not the, major contributor to wear and eventual degradation of the article clamping devices. The art is constantly striving to reduce the effects of friction on such devices so as to extend the functional life thereof. One particular issue which is increasingly becoming a problem is the inability to identify suitable lubrication materials, e.g. greases, which are able to both lubricate clamping devices and provides enhanced chemical and physical resistance to fluids such as cutting fluids which they regularly come into contact with. However, there is also a need to enhance friction control to ensure proper clamping forces. Lubricating grease is conventionally used for sliding parts in the clamping devices described above. Typically general purpose grease using mineral oil as a base oil and one or more alkali metal soaps or alkaline earth metal soaps as a thickening agent is used in such greases.

A lubricating grease composition for an article clamping device needs to produce excellent lubricating properties whilst remaining strongly adhered to metal parts in the clamping mechanism of the device and showing enhanced chemical and physical resistance to fluids such as cutting fluids to which they come into contact. Most of such lubricants are used in metalworking applications and are exposed to water based cutting fluids.

For the avoidance of doubt a cutting fluid is a type of coolant and/or lubricant designed for use in processes, such as the machining and/or stamping of metals. Cutting fluids may be in the form of oils, oil-water emulsions, pastes, gels and may be made from, for example, petroleum distillates, fats, plant oils and/or water. Cutting fluids are used to keep a workpiece at a stable temperature during e.g. machining, can enhance the useful lifetime the tips of cutting tools or the like. However, by their chemical nature they can negatively affect the lubrication of the moving parts of article holding devices not least because they can wash away or chemically interact with greases used.

Resistance to cutting fluid has been mentioned as a required property for products suitable for lubricating article clamping devices as described above. Such cutting fluids have been modified in recent years to fulfil demanding environmental health and safety (EHS) requirements. Current lubricants (greases) have proven to have limited resistance to many of these modified cutting fluid compositions.

A variety of lubricants with various formulations are available in the market for use as "chuck greases." However, most of these products have weaknesses with respect to constant clamping forces and/or resistance against cutting fluids and indeed are deemed to contain hazardous ingredients.

A suitable lubricating grease composition would therefore require to show the following properties:

High constant (or slightly declining) level of clamping force over several cycles;

Strong adhesion on metallic surfaces and resistance of being centrifuged off;

Sufficient chemical and physical resistance against all fluids (especially cutting fluids) used in the metalworking application;

A hardening or washing-out of the lubricant will lead to insufficient lubrication and shorter re-lubrication intervals;

The performance of used cutting fluids should not be negatively influenced by the (chuck) lubricant;

The lubricant should not contain any toxic, environmental toxic or harmful substances; and The lubricant should have some corrosion protection to suppress corrosion which impacts negatively the lubrication and clamping forces.

Many currently available lubricants used in these kind of applications are not able to provide all of these requirements.

BRIEF SUMMARY

This disclosure provides a lubricating composition including:

a) from about 15 to about 55% by weight of one or more solid lubricant powders;
b) from about 30 to about 65% by weight of one or more base oils;
c) from about 0.2 to about 22% by weight of one or more adhesion improvers;
d) from about 0.5 to about 5% by weight of one or more waxes; and
e) from about 2.5 to about 12% by weight of one or more thickeners.

This disclosure also provides a method of lubricating a device, including the step of applying the aforementioned lubricating composition on a surface of a device, wherein the device is a keyed chuck device, keyless chuck device, lathe chuck, collet and fastening device, or mechanism for attaching grinding discs, saw blades, and apparatuses to a drive spindle.

DETAILED DESCRIPTION

The following detailed description is merely exemplary in nature and is not intended to limit the current composition, article, or method. Furthermore, there is no intention to be bound by any theory presented in the preceding background or the following detailed description.

Embodiments of the present disclosure are generally directed to compositions, articles, and methods associated therewith. For the sake of brevity, conventional techniques related to grease compositions and devices for clamping articles may not be described in detail herein. Moreover, the various tasks and process steps described herein may be incorporated into a more comprehensive procedure or process having additional steps or functionality not described in detail herein. In particular, various steps in the manufacture of devices for clamping articles are well-known and so, in the interest of brevity, many conventional steps will only be mentioned briefly herein or will be omitted entirely without providing the well-known process details. In this disclosure, the terminology "about" can describe values ±0.1, 0.5, 1, 2, 3, 4, 5, 6, 7, 8, 9, or 10%, in various embodiments. Moreover, it is contemplated that, in various non-limiting embodiments, all values set forth herein may be alternatively described as approximate or "about." It is contemplated that all isomers and chiral options for each compound described herein are hereby expressly contemplated for use herein. It is also contemplated that any amount or value described herein may alternatively described as "about" that amount or value in various non-limiting embodiments.

This disclosure provides a lubricating grease composition comprising:

a) From about 15 to about 55% by weight of one or more solid lubricants powders;
b) From about 30 to about 65% by weight of one or more base oils;
c) From about 0.2 to about 22% by weight of one or more adhesion improver;
d) From about 0.5 to about 5% by weight of one or more waxes; and
e) From about 2.5 to about 12% by weight of one or more thickeners.

The lubricating grease as described herein is intended to encompass greases which have high levels of solid lubricants and which are sometimes defined within the industry as "pasty" or are described as "pastes" or "grease pastes" which names are sometimes used to emphasize the contribution of the solid contents therein contributing significantly to the consistency of the lubricant composition.

Component a) may be chosen from calcium oxide, zinc oxide, magnesium oxide, calcium hydroxide, zinc hydroxide, magnesium hydroxide, a carbonate such as calcium carbonate, zinc carbonate, magnesium carbonate, calcium fluoride, zinc fluoride, magnesium fluoride, polytetrafluoroethylene (PTFE), titanium dioxide, a phosphorus containing salt such as a phosphoric acid salt, a metaphosphoric acid salt, a diphosphoric acid salt (pyrophosphate), a triphosphoric acid salt (tripolyphosphate), a phosphorous acid salt, a diphosphorus acid salt, or a hypophosphorous acid salt and zinc salts not listed above.

A specific example of a phosphoric acid salt is a metal salt having a counter anion represented by $PO_4^{3-}$. Non-limiting examples of salts are represented by but not limited to the following formulae: $Na_3PO_4$, $Ca_3(PO_4)_2$, $AlPO_4$, $Zn_3(PO_4)_2$, $FePO_4$, $Fe_3(PO_4)_2$, $Sn_3(PO_4)_2$, $Pb_3(PO_4)_2$, etc. Specific non-limiting examples of metaphosphoric acid salts are metal salts having counter anion represented by but not limited to $PO^{3-}$, $P_3O_9^{3-}$, $P_4O_{12}^{4-}$ or similar metal salts. Most preferable are $(NaPO_3)_n$, $K_3P_3O_9$, $K_2Na_2(P_4O_{12})$, etc. A specific example of a diphosphoric acid salt (pyrophosphate) is a metal salt having a counter anion represented by but not limited to $P_2O_7^{4-}$. Most preferable are the following pyrophosphates: $Ca_2P_2O_7$, $Pb_2P_2O_7$, $Fe_4(P_2O_7)_3$, $Zn_2P_2O_7$, $Sn_2P_2O_7$, etc. A specific example of a triphosphoric acid salt (tripolyphosphate) is a metal salt having a counter anion represented by but not limited to $P_3O_{10}^{5-}$. Most preferable are the following tripolyphosphates: $Zn_5(P_3O_{10})$, $Na_5P_3O_{10}$, etc. Phosphorous acid salts can be exemplified by a metal salt having a counter anion represented by but not limited to $PHO^{2-}$. Most preferable are phosphorous acid salts of the following formulae: $ZnHPO_3$, $PbHPO_3$, etc. Diphosphorus acid salts (pyrophosphates) can be exemplified by a metal salt having a counter anion represented by but not limited to $P_2H_2O_5^{2-}$. Most preferable is $Na_2P_2H_2O_5$. Hypophosphorous acid salts can be exemplified by a metal salt having a counter anion represented by $PH_2O_2^-$. Most preferable is $NaPH_2O_2$, or the like. However, the possible hypophosphorous acid salt is not limited by these compounds. In order to provide more uniform dispersion in the lubricating grease composition and prolong the effective period of reducing the friction coefficient on the lubricated parts, Preferred solid lubricants are the aforementioned carbonates (e.g. calcium carbonate), phosphates (e.g. tricalcium phosphate) and zinc salts.

If appropriate Component a), the solid lubricant, may be hydrated or treated to be rendered hydrophobic using, for example stearic acid and/or metal salts of fatty acids such as metal salts of monocarboxylic fatty acids or hydroxymonocarboxylic fatty acids, as well as metal salts of fatty acids derived from animal oils or from vegetable oil, e.g., a seed oil, which are used in the production of metal soaps. Preferable are metal salts of monocarboxylic fatty acids or hydroxymonocarboxylic fatty acids, especially metal salts of the aforementioned fatty acids having about 8 to about 22 carbon atoms. The following are Specific non-limiting examples of the above metal salts of monocarboxylic fatty acids: metal salts of a lauric acid, myristic acid, palmitic acid, stearic acid, behenic acid, myristoleic acid, palmitoleic acid, oleic acid, or a linoleic acid. The following are specific non-limiting examples of metals salts of hydroxymonocarboxylic acids: metal salts of 12-hydroxystearic acid, 14-hydroxystearic acid, 16-hydroxystearic acid, 6-hydroxystearic acid, or 9,10-hydroxystearic acid. The aforementioned metal salts of fatty acids may comprise metal salts of one or more types chosen from the fatty acid salts of lithium, zinc, magnesium, sodium, or aluminum. Any suitable mixture of the above may be utilised, for example hydrated tricalcium phosphate and calcium carbonate treated with stearic acid. Component a) may be present in a range of from about 15% by weight to about 55% by weight of the composition, alternatively about 20% to about 55% by weight of the composition, alternatively about 30% by weight to about 55% by weight of the composition. In various embodiments, component a) is present in an amount of from about 20 to about 55, about 25 to about 55, about 30 to about 50, about 35 to about 45, or about 40 to about 45, % by weight of the composition. In various non-limiting embodiments, all values and ranges of values, both whole and fractional, including and between the aforementioned values for all of the above are hereby expressly contemplated for use herein.

Component b) is one or more base oils. Non-limiting examples thereof include one or more base oil(s) classified by the American Petroleum in Groups I, II, III, IV and V. Lubricant base oils include natural lubricating oils, synthetic lubricating oils, and mixtures thereof. Groups I to III include base oils derived from petroleum based oils, while Groups IV and V include synthetic base oils including silicones. The chemical composition of the base oils from Group I, Group II and Group III can vary substantially, for example regarding the proportions of aromatics, paraffinics, and naphthenics. The degree of refining and the source materials used to produce the lubricant base oils generally determine this composition. Lubricant base oils from Group I, Group II and Group III include paraffinic mineral oils, aromatic mineral oils and naphthenic mineral oils.

The materials of Groups I, II and III are divided into groups based on sulphur content and Viscosity Index as follows:

Group I base oils generally have a Viscosity Index of between about 80 to about 120 and contain greater than about 0.03% by weight of sulfur and/or less than about 90% by weight of saturated organic components (hereafter referred to as "saturates").

Group II base oils generally have a Viscosity Index of between about 80 to 120, and contain less than or equal to about 0.03% by weight of sulfur and greater than or equal to about 90% by weight of saturates.

Group III oils generally have a Viscosity Index greater than about 120 and contain sulphur in an amount less than or equal to about 0.03% weight and greater than about 90% weight of saturates.

In various non-limiting embodiments, all values and ranges of values, both whole and fractional, including and between the aforementioned values for all of the above are hereby expressly contemplated for use herein.

Group IV base oils are composed of polyalphaolefins (PAO) which are hydrogenated oligomers obtained from the oligomerization of alphaolefin monomers. These alphaolefin monomers may have from about 4 to about 30 or from about 4 to about 20 or from about 6 to about 12 carbon atoms, such as hexene, octene or decene. The oligomers may be dimers, trimers, tetramers, pentamers, hexamers of the alphaolefin monomer. In various non-limiting embodiments, all values and ranges of values, both whole and fractional, including and between the aforementioned values for all of the above are hereby expressly contemplated for use herein.

Group V base oils include base oils not included in Groups I-IV such as polyinternal olefins (PIO); polyalkylene glycols (PAG); alkylated aromatics such as alkylated benzenes (e.g., dodecylbenzene, tetradecylbenzene, di-nonylbenzene, and di-(2-ethylhexyl)benzene); polyphenyls (e.g., biphenyls, terphenyl and alkylated polyphenyls); synthetic esters such as esters of dicarboxylic acids (e.g., dibutyl adipate, di(2-ethylhexyl)sebacate, di-n-hexyl fumarate, dioctyl sebacate, diisooctyl azelate, diisodecyl azelate, dioctyl phthalate, didecyl phthalate and dieicosyl sebacate); esters of carboxylic acids, polyol esters (e.g., neopentyl glycol, trimethylolethane, trimethylpropane, pentaerythritol, dipentaerythritol and tripentaerythritol); phosphate esters (e.g., tricresyl phosphate, trioctylphosphate, and diethyl ester of decylphosphonic acid); silicones, silicone based copolymers, polyisobutylene (PIB) and halogenated hydrocarbons.

Other lubricant base oils include those of vegetal and animal origin, such as vegetal fatty acids, rapeseed oil, castor oil and lard oil.

Preferred base oils include, synthetic hydrocarbon oils, polyalphaolefins (PAO), polyalkylene glycols (PAG), paraffin-type mineral oil, a diester, a polyol-ester, or a similar ester-type synthetic oil; a co-oligomer of ethylene and α-olefin, a polybutene, or a similar synthetic hydrocarbon oil; an alkylene diphenyl ether, a polyalkylene ether, or a similar ether-type synthetic oil; a diester and a polyol ester, or a similar ester-type oil; and a polydimethyl silicone, a polymethylphenyl silicone, or a similar silicone oil, including silicone based copolymers. These base oils may be used alone or in mixtures of the above. It is further preferable that kinematic viscosity of the base oil of one or more types is in the range of about 5 to about 2000 $mm^2/s$. at 40° C. In various embodiments, The base oil is present in an amount of about 30 to about 65, about 35 to about 60, about 40 to about 55, or about 45 to about 50, % by weight of the composition. In various non-limiting embodiments, all values and ranges of values, both whole and fractional, including and between the aforementioned values for all of the above are hereby expressly contemplated for use herein.

Component c) is one or more adhesion Improvers such as a polyisobutylene having a number average molecular weight (Mn) of from about 200 to about 6000, or other polymers dissolved in oil like Poly(methyl methacrylate) and thermoplastic elastomer block-copolymers from the groups TPE-A, thermoplastic copolyesters (TPE-E), thermoplastic olefins (TPE-O), thermoplastic styrene block copolymers (TPE-S), thermoplastic polyurethanes (TPE-U) and/or elastomeric alloys (TPE-V). In various embodiments, Component c) is present in an amount of from about 0.2 to about 22, about 0.5 to about 20% by weight of the composition, alternatively from about 1 to about 15% by weight of the composition. In other embodiments component c) is present in an amount of from about 0.5 to about 21.5, about 1 to about 21, about 1.5 to about 20, about 2 to about 19.5, about 2.5 to about 19, about 3 to about 18.5, about 3.5 to about 18, about 4 to about 17.5, about 4.5 to about 17, about 5 to about 16.5, about 5.5 to about 16, about 6 to about 15.5, about 6.5 to about 15, about 7 to about 14.5, about 7.5 to about 14, about 8 to about 13.5, about 8.5 to about 13, about 9 to about 12.5, about 9.5 to about 12, about 10 to about 11.5, or about 10.5 to about 11, % by weight of the composition. In various non-limiting embodiments, all values and ranges of values, both whole and fractional, including and between the aforementioned values for all of the above are hereby expressly contemplated for use herein.

Component d) comprises one or more waxes provided to adjust friction and increase hydrophobicity, non-limiting examples include natural waxes such as beeswax, synthetic hydrocarbon waxes and polymer waxes and mixtures thereof. The wax is present in the composition in an amount of from about 0.5 to about 5% by weight of the composition. In various embodiments, the wax is present in an amount of from about 0.5 to about 5, about 1 to about 4.5, about 1.5 to about 4, about 2 to about 3.5, about or 2.5 to about 3, % by weight of the composition. In various non-limiting embodiments, all values and ranges of values, both whole and fractional, including and between the aforementioned values for all of the above are hereby expressly contemplated for use herein.

Component e) is a thickener for stabilizing the composition, to help retain the base oil and increase resistance towards liquids such as cutting fluids: these may include metallic single and complex soaps of lithium, aluminium, zinc, magnesium, sodium, barium and calcium as well as non-soap organic (Polymer, Polyurea, PTFE) and inorganic (Silica, Bentonite) materials and mixtures thereof, for example, lithium-12-hydroxystearate and zinc stearate. Component e) may be present in an amount of from about 2.5 to about 12, about 3 to about 11.5, about 3.5 to about 11, about 4 to about 10.5, about 4.5 to about 10, about 5 to about 9.5, about 5.5 to about 9, about 6 to about 8.5, about 6.5 to about 8, or about 7 to about 7.5, % by weight of the composition. In various non-limiting embodiments, all values and ranges of values, both whole and fractional, including and between the aforementioned values for all of the above are hereby expressly contemplated for use herein.

The above includes any combination of the alternative ranges of each component providing together and optionally with the additives mentioned below the total % by weight of the composition is 100% by weight.

When required, the lubricating grease composition as hereinbefore described may include one or more conventionally used additives. Such additives include friction modifiers, anti-wear additives, extreme pressure additives, seal swelling agents, rust and corrosion inhibitors, pour point depressants, anti-oxidants, free-radical scavengers, hydroperoxide decomposers, metal passivators, surface active agents such as detergents, emulsifiers, demulsifiers, defoamants, dispersants, and mixtures thereof.

Further additives include deposit control additives, dyes, film forming additives, tackifiers, antimicrobials, additives for biodegradable lubricants, haze inhibitors, chromophores, and limited slip additives.

Non-limiting examples of friction modifiers include long-chain fatty acids and their derivatives, molybdenum compounds, aliphatic amines or ethoxylated aliphatic amines, ether amines, alkoxylated ether amines, acylated amines, tertiary amines, aliphatic fatty acid amides, aliphatic carboxylic acids, aliphatic carboxylic esters, polyol esters, aliphatic carboxylic ester-amides, imidazolines, aliphatic phosphonates, aliphatic phosphates, aliphatic thiophosphonates, aliphatic thiophosphates.

Non-limiting examples of anti-wear additives and extreme pressure additives include organosulfur and organophosphorus compounds, such as organic polysulfides among which alkylpolysulfides; phosphates among which trihydrocarbyl phosphate, dibutyl hydrogen phosphate, amine salt of sulfurized dibutyl hydrogen phosphate, dithiophosphates; dithiocarbamates dihydrocarbyl phosphate; sulfurized olefins, such as sulfurized isobutylene, and sulfurized fatty acid esters.

Non-limiting examples of seal swell agents include esters, adipates, sebacates, azeealates, phthalates, sulfones such as 3-alkoxytetraalkylene sulfone, substituted sulfolanes, aliphatic alcohols of 8 to 13 carbon atoms such as tridecyl alcohol, alkylbenzenes, aromatics, naphthalene depleted aromatic compounds, mineral oils.

Non-limiting examples of rust and corrosion inhibitors include monocarboxylic acids such as octanoic acid, decanoic acid and dodecanoic acid; polycarboxylic acids such as dimer and trimer acids from tall oil fatty acids, oleic acid, linoleic acid; thiazoles; triazoles such as benzotriazole, decyltriazole, 2-mercapto benzothiazole; thiadiazoles such as 2,5-dimercapto-1,3,4-thiadiazole, 2-mercapto-5-hydrocarbyldithio-1,3,4-thiadiazole; metal dithiophosphates; ether amines; acid phosphates; amines; polyethoxylated compounds such as ethoxylated amines; ethoxylated phenols; ethoxylated alcohols; imidazolines; aminosuccinic acids and esters of aminosuccinic acids.

Non-limiting examples of pour point depressants include wax-alkylated naphthalenes and phenols, polymethacrylates, styrene-ester copolymers.

Non-limiting examples of anti-oxidants include phenolic antioxidants such as 2,6-di-tert-butylphenol, tertiary butylated phenols such as 2,6-di-tert-butyl-4-methylphenol, 4,4'-methylenebis(2,6-di-tert-butylphenol), 2,2'-methylenebis(4-methyl6-ter t-butylphenol), 4,4'-thiobis(2-methyl-6-tert-butylphenol); mixed methylene-bridged polyalkyl phenols; aromatic amine antioxidants; sulfurized phenolic antioxidants; organic phosphites; amine derivatives such as p-, p'-dioctyldiphenylamine, N,N'-di-sec-butylphenylenediamine, 4-isopropylaminodiphenyl amine, phenyl alpha naphthyl amine, ring-alkylated diphenylamines; bisphenols; cinnamic acid derivatives.

Non-limiting examples of free-radical scavengers include zinc dialkyl dithiophosphates, hindered phenols, and alkylated arylamines.

Non-limiting examples of hydroperoxide decomposers include organo-sulfur compounds and organo-phosphorus compounds.

Non-limiting examples of metal passivators include polyfunctional (polydentate) compounds, such as ethylenediaminetetraacetic acid (EDTA) and salicylaldoxime.

Non-limiting examples of surface active agents such as detergents, dispersants, emulsifiers, demulsifiers include alkali metal or alkaline earth metal salts of organic acids such as magnesium sulfonate, zinc sulfonate, magnesium phenate, zinc phenate, lithium sulfonate, lithium carboxylate, lithium salicylate, lithium phenate, sulfurized lithium phenate, magnesium sulfonate, magnesium carboxylate, magnesium salicylate, magnesium phenate, sulfurized magnesium phenate, potassium sulfonate, potassium carboxylate, potassium salicylate, potassium phenate, sulfurized potassium phenate; common acids such as alkylbenzenesulfonic acids, alkylphenol s, fatty carboxylic acids, polyamine, polyhydric alcohol derived polyisobutylene derivatives.

Non-limiting examples of defoamants include polysiloxanes, polyacrylates and styrene ester polymers.

Non-limiting examples of dispersants include alkenylsuccinimide such as polyisobutylene succinimide, N-substituted polyisobutenyl succinimides such as polyisobutenyl succinimide-polyethylenepolyamine, succinates, succinate esters, alkyl methacrylate-vinyl pyrrolidinone copolymers, alkyl methacrylate-dialkylaminoethyl methacrylate copolymers, alkylmethacrylate-polyethylene glycol methacrylate copolymers, polystearamides, high molecular weight amines, phosphoric acid derivatives such as bis-hydroxypropyl phosphorate.

Some additives may possess multiple properties and may be provided for a variety of effects. For example, graphite and molybdenum disulfide may both be used as friction modifiers and extreme pressure additives or functionalized soaps may be used to thicken but also provide greases with extreme pressure and antiwear performances. This approach is well known by the person skilled in the art and need not be further elaborated herein.

An additive may be used alone or in combination with other additives.

When present in the lubricant composition of the disclosure, the sole or multiple additive(s) may be used at a level of from about 0 to about 10 wt %, alternatively about 0.1 to about 5 wt %, based on the total weight of the lubricating grease composition. In various non-limiting embodiments, all values and ranges of values, both whole and fractional, including and between the aforementioned values for all of the above are hereby expressly contemplated for use herein.

Hence the lubricating grease composition may comprise any combination of:

a) From about 15 to about 55% by weight, alternatively about 20% to about 55% by weight of the composition, alternatively about 30% by weight to about 55% by weight of the composition of one or more solid lubricant powders;

b) From about 30 to about 65% by weight, alternatively about 30 to about 60% by weight of the composition, alternatively from about 35% to about 55% by weight of the composition, of one or more base oils;

c) From about 0.2 to about 22, from about 0.5 to about 20% by weight of the composition, alternatively from 1 to 15% by weight of the composition, of one or more adhesion improvers;

d) From about 0.5 to about 5% by weight of the composition, alternatively from about 0.5 to about 2.5 by weight of the composition, alternatively from about 1% to about 5% by weight of the composition, of one or more waxes; and e) From about 2.5 to about 12% by weight of the composition, alternatively from about 3.5% to about 10% by weight of the composition, alternatively from about 4.5% to about 8% by weight of the composition, of one or more thickeners; and from about 0 to about 10% by weight of the composition of lubricating additives and wherein the total % weight of the composition is about 100%.

In various non-limiting embodiments, all values and ranges of values, both whole and fractional, including and between the aforementioned values for all of the above are hereby expressly contemplated for use herein.

The lubricating grease composition as hereinbefore described produces excellent lubricating properties in article clamping devices whilst remaining strongly adhered to metal parts in the clamping mechanism of the device for longer periods of time than commercially available materials for the same purpose. The composition provides enhanced chemical and physical resistance to fluids, such as cutting fluids, to which they come into contact. The composition is able to maintain the friction coefficient of the metal parts within a workable range whilst also retaining the ability to apply adequate clamping forces on an object being clamped or to be clamped. It is appreciated that the coefficient of friction has to be sufficiently >zero, because if it were zero, clamping forces could not be effectively applied to articles to be clamped or being clamped but equally the clamping forces need to be prevented from being too high as this is likely to cause wear on the clamping parts. As a result article clamping devices lubricated with the composition as hereinbefore described have prolonged endurance times for the lubricated parts before the article clamping device has to be re-lubricated even if they are using under severe conditions.

The lubricating grease as hereinbefore described may be made by any suitable method, for example it can be prepared by mixing components a) to e) in any suitable order and introducing optional additives, if present, at appropriate points in the preparation. In one suitable method the lubricating grease composition may be prepared by adding adhesion promoter c), waxes d) and thickeners e) to the base oil(s) b). Components b) to e) are stirred, and if required heated until said components b) to e) are homogeneously mixed. Component a) the solid lubricant(s) are then added to the composition and mixed until homogeneous. The resulting homogeneous mixture is the allowed to cool to room temperature with continuous stirring. Optional additives, if required, may be added to the composition at any point during the process, for example during this cooling step. The resulting homogeneous grease may, if required, be finished by using 3-roll mills or other suitable finishing devices.

The lubricating grease composition of this disclosure forms lubricating films on the surfaces of moving parts in article clamping devices such as, for the sake of example, chuck devices (both keyed and keyless) which are used to hold tools with radial symmetry in e.g. drills and mills. Other clamping devices include collet devices which generally are used in situations where a collar around an article to be held and exerts a strong clamping force on the object as it is tightened, usually by means of a tapered outer collar. Other clamping devices include lathe chucks. Other article clamping devices include fastening devices or mechanisms for attaching grinding discs, saw blades, and the like to drive spindles (may include conventional nuts, torque enhancing nuts, or similar mechanisms) and systems for clamping rotating workpieces in lathes and the like.

The lubricating grease as hereinbefore described improve the functional lifetime of the clamping devices before the lubricant has to be replaced, not least because of their resistance to the aforementioned cutting fluids. Indeed it would seem that the lubricating greases as provided herein fulfil the desired following properties:

(i) Maintenance of clamping forces. It was unexpectedly identified that the lubricating grease as herein described was after application to an article clamping device (chuck), able to maintain the clamping forces of the device (chuck) within a predetermined range over extended periods of time and large number of device "fastenings and unfastenings when used with or without cutting fluid, i.e. the clamping forces were sufficient to engage and clamp a large number of articles to enable the article to be engineered or to be used to complete a task and the lubricant grease was not removed by the effect of the cutting fluid to the extent that wear commenced. The device was re-greased after a significantly greater number of fastening and unfastenings of the clamp than previously possible using prior art commercial greases for the same purpose.

(ii) Strong adhesion on metallic surfaces and resistance of being centrifuged off. Given (i) above it is appreciated that the lubricating grease as described herein is strongly adhered to the lubricated parts of the clamping device and is not easily removed by interaction with, for example, the cutting fluid or due to centrifugal forces if/when a clamped article is rotated, particularly at high speed.

(iii) Sufficient chemical and physical resistance against all fluids (especially water and cutting fluids) used in the metalworking application.

Given (i) and (ii) above it is a direct consequence that it can be seen that the lubricating grease as hereinbefore described must have sufficient chemical and physical resistance to, for example, cutting fluids, otherwise the grease would be removed due to the chemical and physical interaction with the cutting fluid. If this were not the case, the clamping device (chuck) would need to be re-lubricated much more regularly. This is supported below from the results of the cutting fluid resistance test based on a modified version of DIN 51807 pt. 1" shown in Table 3 below.

Additional Embodiments

In various embodiments, this disclosure provides a device for clamping an article with sufficient clamping force, as first introduced above. The device is not particularly limited and may be further described as a keyed chuck device, keyless chuck, collet fastening devices, etc.

The device typically includes an actuation member having a first surface; an engaging member having a second surface and slidingly engageable with the actuation member such that the first surface is contactable with the second surface and produces friction therebetween.

Typical non-limiting examples of the actuation member include any portion of a keyed chuck device, keyless chuck, collet fastening devices, etc, as understood by one of skill in the art.

Typical, non-limiting examples of the engaging member include any portion of a keyed chuck device, keyless chuck, collet fastening devices, etc, as understood by one of skill in the art.

The device also typically includes a lubricating grease composition disposed in contact with the first and second surfaces to reduce the friction therebetween. One embodiment of such a device is set forth in FIGS. 1A and/or 1B. The aforementioned composition may be any described herein and may include:

a) from about 15 to about 55% by weight of one or more solid lubricants powders;
b) from about 30 to about 65% by weight of one or more base oils;
c) from about 0.2 to about 22% by weight of one or more adhesion improver;
d) from about 0.5 to about 5% by weight of one or more waxes; and
e) from about 2.5 to about 12% by weight of one or more thickeners.

In various embodiments, a) is present in an amount of from about 15 to about 55, about 20 to about 50, about 25 to about 45, about 30 to about 40, or about 35 to about 40, % by weight, based on a total weight of the composition. In various embodiments, a) includes hydrated tricalcium phosphate and calcium carbonate treated with stearic acid. In various non-limiting embodiments, all values and ranges of values, both whole and fractional, including and between the aforementioned values are hereby expressly contemplated for use herein.

In other embodiments, b) is present in an amount of from about 30 to about 65, about 35 to about 60, about 40 to about 55, or about 45 to about 50, % by weight, based on a total weight of the composition. In various embodiments, b) includes mineral oil. In various non-limiting embodiments, all values and ranges of values, both whole and fractional, including and between the aforementioned values are hereby expressly contemplated for use herein.

In other embodiments, c) is present in an amount of from about 0.2 to about 22, about 0.5 to about 25, about 1 to about 25, about 1 to about 20, about 5 to about 25, about 5 to about 20, about 10 to about 15, about 0.5 to about 1, about 0.6 to about 0.9, or about 0.7 to about 0.8, % by weight, based on a total weight of the composition. In other embodiments component c) is present in an amount of from about 0.5 to about 21.5, about 1 to about 21, about 1.5 to about 20, about 2 to about 19.5, about 2.5 to about 19, about 3 to about 18.5, about 3.5 to about 18, about 4 to about 17.5, about 4.5 to about 17, about 5 to about 16.5, about 5.5 to about 16, about 6 to about 15.5, about 6.5 to about 15, about 7 to about 14.5, about 7.5 to about 14, about 8 to about 13.5, about 8.5 to about 13, about 9 to about 12.5, about 9.5 to about 12, about 10 to about 11.5, or about 10.5 to about 11, % by weight of the composition. In various embodiments, c) includes polyisobutylene. In various non-limiting embodiments, all values and ranges of values, both whole and fractional, including and between the aforementioned values are hereby expressly contemplated for use herein.

In other embodiments, d) is present in an amount of from about 0.5 to about 5, about 1 to about 4.5, about 1.5 to about 4, about 2 to about 3.5, about 2.5 to about 3, about 0.5 to about 1, about 0.6 to about 0.9, or about 0.7 to about 0.8, % by weight, based on a total weight of the composition. In various embodiments, d) includes beeswax and synthetic hydrocarbon wax. In various non-limiting embodiments, all values and ranges of values, both whole and fractional, including and between the aforementioned values are hereby expressly contemplated for use herein.

In other embodiments, e) is present in an amount of from about 2.5 to about 12, or about 2.5, 3, 3.5, 4, 4.5, 5, 5.5, 6, 6.5, 7, 7.5, 8, 8.5, 9, 9.5, 10, 10.5, 11, 11.5 or 12, % by weight, based on a total weight of the composition. In various embodiments, e) includes lithium-12-hydroxystearate and zinc stearate. In various non-limiting embodiments, all values and ranges of values, both whole and fractional, including and between the aforementioned values are hereby expressly contemplated for use herein.

In other embodiments, the composition includes an optional corrosion inhibitor present in an amount of from about 0 to about 1% by weight, based on a total weight of the composition. In various non-limiting embodiments, all values and ranges of values, both whole and fractional, including and between the aforementioned values are hereby expressly contemplated for use herein.

In still other embodiments, the composition includes the following:

Solid Lubricants

Calcium Carbonate present in an amount of from about 5 to about 42, about 10 to about 40, about 15 to about 35, about 20 to about 30, about 25 to about 30, or any value or range of values, including both whole and fractional, set forth in the Examples, weight percent based on a total weight of the composition;

Tricalcium Phosphate present in an amount of from about 3.9 to about 15.5, about 5 to about 10, about 10 to about 15, or any value or range of values, including both whole and fractional, set forth in the Examples, weight percent based on a total weight of the composition;

Zinc Sulfide present in an amount of from about 2 to about 10, about 2 to about 5, about 2, 3, 4, or 5, or any value or range of values, including both whole and fractional, set forth in the Examples, weight percent based on a total weight of the composition;

Adhesion Improver

Polyisobutylene present in an amount of about 8 to about 20, about 10 to about 15, about 15 to about 20, or any value or range of values, including both whole and fractional, set forth in the Examples, weight percent based on a total weight of the composition;

Ethylene/Propylene Copolymer present in an amount of from about 0.5 to about 10, about 0.5 to about 5, about 5 to about 10, or any value or range of values, including both whole and fractional, set forth in the Examples, weight percent based on a total weight of the composition;

Base Oils

White Mineral Oil present in an amount of from about 5 to about 37, about 5 to about 35, about 10 to about 30, about 15 to about 25, about 15 to about 20, or any value or range of values, including both whole and fractional, set forth in the Examples, weight percent based on a total weight of the composition;

Mineral Oil present in an amount of from about 14 to about 48, about 15 to about 45, about 20 to about 40, about 25 to about 35, about 35 to about 30, or any value or range of values, including both whole and fractional, set forth in the Examples, weight percent based on a total weight of the composition;

Thickener

Li-12-Hydroxystearate present in an amount of about 1 to about 5, about 1, 2, 3, 4, or 5, or any value or range of values, including both whole and fractional, set forth in the Examples, weight percent based on a total weight of the composition;

Zinc Stearate present in an amount of about 0.95 to about 6, about 1, 2, 3, 4, 5, or 6, or any value or range of values, including both whole and fractional, set forth in the Examples, weight percent based on a total weight of the composition;

Waxes

Beeswax present in an amount of from about 0.25 to about 2.5, about 0.25 to about 1.5, about 0.25 to about 1.25, about 0.25 to about 1, about 0.25 to about 0.75, about 0.25 to about 0.5, about 0.5 to about 1.5, or about 1 to about 1.5, or any value or range of values, including both whole and fractional, set forth in the Examples, weight percent based on a total weight of the composition;

Synthetic Hydrocarbon Wax present in an amount of from 0.25 to about 2.5, about 0.25 to about 1.5, about 0.25 to about 1.25, about 0.25 to about 1, about 0.25 to about 0.75, about 0.25 to about 0.5, about 0.5 to about 1.5, or about 1 to about 1.5, or any value or range of values, including both whole and fractional, set forth in the Examples, weight percent based on a total weight of the composition.

Corrosion Inhibitor

Corrosion Inhibitor, such as a semi-ester of succinic acid derivatives used in the Examples, present in an amount of from about 0.25 to about 2.5, about 0.25 to about 1.5, about 0.25 to about 1.25, about 0.25 to about 1, about 0.25 to about 0.75, about 0.25 to about 0.5, about 0.5 to about 1.5, or about 1 to about 1.5, or any value or range of values, including both whole and fractional, set forth in the Examples, weight percent based on a total weight of the composition.

In various non-limiting embodiments, all values and ranges of values, both whole and fractional, including and between the aforementioned values for all of the above are hereby expressly contemplated for use herein.

In still other embodiments, the composition includes one or more solid lubricants, one or more adhesion improvers, one or more base oils, one or more waxes, and/or one or more corrosion inhibitors, or combinations thereof, in any individual amount or sum of any two or more amounts set forth above. Moreover, In various non-limiting embodiments, all values and ranges of values, both whole and fractional, including and between the aforementioned values for all of the above are hereby expressly contemplated for use herein.

In still other embodiments, the one or more solid lubricant powders comprises a first solid lubricant comprising an alkaline earth metal carbonate; a second solid lubricant comprising a tri-alkaline earth metal phosphate; and an optional third solid lubricant comprising a group IIB, IIIA, or IVA metal sulfide. For example, Group IIB metals include zinc, cadmium, and mercury. Group IIIA metals include aluminum, gallium, indium, and thallium. Group IVA metals include germanium, tin, and lead.

In other embodiments, the first solid lubricant is calcium carbonate; the second solid lubricant is tricalcium phosphate; and the third solid lubricant is zinc sulfide.

In other embodiments, the adhesion improver comprises a polyisobutylene having a number average molecular weight (Mn) of from about 200 to about 6000, about 500 to about 5500, about 1000 to about 5000, about 1500 to about 4500, about 2000 to about 4000, about 2500 to about 3500, or about 2500 to about 3000, g/mol. In various non-limiting embodiments, all values and ranges of values, both whole and fractional, including and between the aforementioned values for all of the above are hereby expressly contemplated for use herein.

In other embodiments, the adhesion improver comprises a ethylene/propylene copolymer.

In other embodiments, the base oil is a mineral oil which may be any known in the art.

In other embodiments, the thickener comprises Li-12 hydroxystearate and/or Zinc Stearate.

In other embodiments, the wax comprises beeswax and/or a synthetic hydrocarbon wax.

In other embodiments, the method comprises the steps of: providing an article; providing the device; and contacting the engaging member with the article to clamp the article with the sufficient clamping force.

In other embodiments, the composition comprises, consists essentially of, or consists of:

a) from about 15 to about 51% by weight of one or more solid lubricants powders;
b) from about 33 to about 62% by weight of one or more base oils;
c) from about 0.5 to about 20% by weight of one or more adhesion improver;
d) from about 0.5 to about 5% by weight of one or more waxes; and
e) from about 2.5 to about 11% by weight of one or more thickeners.

In other embodiments, the composition comprises about 5 to about 42 weight percent of a first solid lubricant; about 3.9 to about 15.5 weight percent of a second solid lubricant; and about 0 to about 2.85 weight percent of a third solid lubricant.

In all of the above, and throughout, in various non-limiting embodiments, all values and ranges of values, both whole and fractional, including and between the aforementioned values for all of the above are hereby expressly contemplated for use herein.

In other embodiments, the device includes an actuation member having a first surface; an engaging member having a second surface and slidingly engageable with the actuation member such that the first surface is contactable with the second surface and produces friction therebetween; and a lubricating grease composition disposed in contact with the first and second surfaces to reduce the friction therebetween, the composition as described in this disclosure. In other embodiments, the solid lubricant comprises about 5 to about 42 weight percent of a first solid lubricant; about 3 to about 15.5 weight percent of a second solid lubricant; and about 0 to about 3 weight percent of a third solid lubricant. In other embodiments, the first solid lubricant comprises an alkaline earth metal carbonate; the second solid lubricant comprises a tri-alkaline earth metal phosphate; and the third solid lubricant comprises a group IIB, IIIA, or IVA metal sulfide. In other embodiments, the first solid lubricant is calcium carbonate; the second solid lubricant is tricalcium phosphate; and the third solid lubricant is zinc sulfide. In other embodiments, the adhesion improver comprises a polyisobutylene having a number average molecular weight (Mn) of from about 200 to about 6000 g/mol. In other embodiments, the adhesion improver comprises a ethylene/ propylene copolymer. In other embodiments, the base oil is a mineral oil. In other embodiments, the method includes the steps of providing the article; providing the aforementioned device, and contacting the engaging member with the article to clamp the article with the sufficient clamping force. In various non-limiting embodiments, all values and ranges of values, both whole and fractional, including and between the aforementioned values for all of the above are hereby expressly contemplated for use herein.

This disclosure also provides a method of clamping an article, the method comprising the steps of providing an article; providing the aforementioned device; and contacting the engaging member with the article to clamp the article with the sufficient clamping force.

All combinations of/options for the aforementioned components, method steps, chemistries, and amounts are hereby expressly contemplated for use in various non-limiting embodiments.

It is contemplated that any of the compositions described herein may be described as comprising, consisting essentially of, or consisting of, the relevant components. The terminology "consisting essentially of" may describe embodiments that are free of, or include less than 10, 9, 8, 7, 6, 5, 4, 3, 2, 1, 0.5, or 0.1, weight percent based on a total weight of the composition, of one or more solid lubricants powders, base oils, adhesion improvers, waxes, thickeners, corrosion inhibitors, additives, etc. that are not described herein or that are described as optional herein.

In various embodiments, unworked and worked penetration can be assessed to determine grease penetration. In various embodiments, an optimum grease penetration range is from about 265 mm/10 to about 340 mm/10 as it tends to provide the best consistency for the application. This is because the resulting composition is typically suitable to be used with grease guns whilst also being sufficiently "pasty" to stick on lubricated metal parts. Values outside this range may also be suitable for use as and when appropriate and based on the specific application. Flow pressure can also be measured to determine whether a grease will have sufficient pumpability at temperatures below e.g. −20° C. In various embodiments, a flow pressure of less than 1400 mbar is generally interpreted to mean that there should be an appropriate level of pumpability at such lower temperatures. In various non-limiting embodiments, all values and ranges of values, both whole and fractional, including and between the aforementioned values for all of the above are hereby expressly contemplated for use herein.

In other embodiments, dropping point can be used as an indication of the thermal stability of the lubricating grease composition as described herein. This value typically needs to be significantly above the working temperature of a clamping device. It is anticipated that clamping devices such as chucks and collets will function up to about 60° C., not least because of the cutting fluid acting as coolant.

In other embodiments, water resistance can be an important feature for greases for these applications because the cutting fluids can be water based emulsions. In various embodiments, instead of the normal period of three hours used under DIN 51807 pt. 1, samples can be tested for water resistance for a full 24 hours. Cutting fluid resistance can be assessed based on DIN 51807 pt. 1 excepting that the tests can be undertaken over a 7 day period at room temperature.

In still other embodiments, a level of clamping force can be assessed based on stability over 100 tightening cycles. In various embodiments, clamping force drop is calculated by

[average clamping force]/[cycle 1 clamping force] *100(%)

In still other embodiments, this disclosure provides a method of lubricating a device, comprising the steps of applying the composition of this disclosure on a surface of a device, wherein the device is a keyed chuck device, keyless chuck device, lathe chuck, collet and fastening devices, or mechanisms for attaching grinding discs, saw blades, and apparatuses to drive spindles.

In other embodiments, this disclosure provides a lubricating grease or paste consisting essentially of:

a) from about 15 to about 55% by weight of one or more solid lubricant powders comprising:
   - a first solid lubricant comprising an alkaline earth metal carbonate;
   - a second solid lubricant comprising an alkaline earth metal phosphate; and
   - an optional third solid lubricant comprising a group IIB, IIIA, or IVA metal sulfide;
b) from about 30 to about 65% by weight of one or more base oils chosen from mineral oils;
c) from about 0.2 to about 22% by weight of one or more adhesion improver;
d) from about 0.5 to about 5% by weight of one or more waxes; and
e) from about 2.5 to about 12% by weight of one or more thickeners, wherein the one or more adhesion improvers is chosen from a polyisobutylene having a number average molecular weight (Mn) of from about 200 to about 6000 g/mol, an ethylene/propylene copolymer, and combinations thereof;

wherein the one or more waxes is chosen from beeswax, a synthetic hydrocarbon wax, and combinations thereof; and wherein the one or more thickeners is chosen from Li-12 hydroxystearate, Zinc Stearate, and combinations thereof. In various non-limiting embodiments, all values and ranges of values, both whole and fractional, including and between the aforementioned values for all of the above are hereby expressly contemplated for use herein.

For example, in various related embodiments, the first solid lubricant is calcium carbonate; the second solid lubricant is tricalcium phosphate or hydroxyl apatite; and the third solid lubricant is zinc sulfide.

In other related embodiments, the composition includes about 5 to about 42 weight percent of the first solid lubricant; about 3.9 to about 15.5 weight percent of the second solid lubricant; and about 0 to about 2.85 weight percent of the third solid lubricant. In various non-limiting embodiments, all values and ranges of values, both whole and fractional, including and between the aforementioned values for all of the above are hereby expressly contemplated for use herein.

In other related embodiments, the composition has an Unworked Penetration of about 240 to about 350 mm/10 measured by ISO 2137 (2007). In various embodiments, this penetration is from about 245 to about 345, about 250 to about 340, about 255 to about 335, about 260 to about 330, about 265 to about 325, about 270 to about 320, about 275 to about 315, about 280 to about 310, about 285 to about 305, about 290 to about 300, or about 295 to about 300, mm/10 measured by ISO 2137 (2007). In various non-limiting embodiments, all values and ranges of values, both whole and fractional, including and between the aforementioned values for all of the above are hereby expressly contemplated for use herein.

In various embodiments, the composition may have one, more than one, or none of the following physical properties, as optionally measured in water in an amount of from about 5 to about 12 wt % actives, wherein each value can alternatively be labeled as "about":

Unworked Penetration, ISO 2137: 2007 (en) (mm/10): 267-329

Worked Penetration, ISO 2137 2007 (en) 60× (mm/10): 290-334

Density @20° C., DIN 51757: 2011-01 (g/ml): 1.02-1.32

Flow Pressure @−20° C., DIN 51805-2: 2016-09 (mbar): 550-1075

Dropping Point, Energy Institute IP 396/02, 10K/min (° C.): 174-232

Water Resistance, 24 h/90° C., DIN 51807 pt. 1: 0-90

Cutting fluid resistance, tested for a 7 day period at room temperature with 3 different commercial cutting fluids, on basis of DIN 51807 pt. 1: 0-25 or 1-25.

In various non-limiting embodiments, all values and ranges of values, both whole and fractional, including and between the aforementioned values for all of the above are hereby expressly contemplated for use herein.

EXAMPLES

The disclosure will be further described with reference to practical examples and comparative examples. It is understood, however, that the disclosure is not limited by the aforementioned practical examples. Various examples were created and evaluated as set forth below.

TABLE 1

| Type of Material | Ingredient | Example 1 | Example 2 | Example 3 |
|---|---|---|---|---|
| Solid Lubricants | Calcium Carbonate | 5.00% | 40.63% | 7.00% |
| | Tricalcium Phosphate/ Hydroxylapatite | 15.50% | 9.10% | 8.00% |
| | Zinc Sulfide | 2.85% | — | — |
| Adhesion improver | Polyisobutylene Mn = 900-2500 | — | 8.81% | 20.00% |
| | Ethylene/propylene Copolymer | 0.50% | — | — |
| Base oils | White Mineral Oil - Highly refined mineral oil (liquid paraffin) | — | 18.84% | 5.00% |
| | Mineral Oil - Highly refined naphthenic and paraffinic mineral oil | 44.16% | 15.93% | 47.46% |
| Thickener | Li-12-Hydroxystearate | 4.69% | 1.69% | 5.04% |
| | Zinc Stearate | — | 0.98% | 6.00% |
| Waxes | Beeswax | — | 1.52% | 0.25% |
| | Synthetic Hydrocarbon Wax - Hard paraffinic (non functionalized) | 1.00% | 1.52% | 0.25% |
| Additives | Corrosion Inhibitor - Semi-ester of succinic acid derivate | — | 0.98% | 1.00% |
| | Total | 100% | 100% | 100% |

| Type of Material | Ingredient | Example 4 | Example 5 | Example 6 |
|---|---|---|---|---|
| Solid Lubricants | Calcium Carbonate | 41.50% | 17.00% | 25.00% |
| | Tricalcium Phosphate/ Hydroxylapatite | 9.30% | 3.90% | 5.70% |
| | Zinc Sulfide | — | — | — |
| Adhesion improver | Polyisobutylene Mn = 900-2500 | 9.00% | 10.00% | 7.50% |
| | Ethylene/propylene Copolymer | — | — | — |
| Base oils | White Mineral Oil - Highly refined mineral oil (liquid paraffin) | 14.30% | 25.00% | 36.50% |
| | Mineral Oil (paraffinic and/or naphthenic base) | 18.71% | 37.06% | 13.11% |
| Thickener | Li-12-Hydroxystearate | 1.99% | 3.94% | 1.39% |
| | Zinc Stearate | 1.00% | — | 6.00% |
| Waxes | Beeswax | 1.60% | 1.55% | 2.40% |
| | Synthetic Hydrocarbon Wax - Hard paraffinic (non-functionalized) | 1.60% | 1.55% | 2.40% |
| Additives | Corrosion Inhibitor - Semi-ester of succinic acid derivate | 1.00% | — | — |
| | Total | 100% | 100% | 100% |

It can be seen from the composition content that the lubricant grease as described herein does not contain any toxic, environmental toxic or harmful substances.

Comparative Example 1

An additional comparative example was also evaluated. More specifically, a commercial white colored product intended for use as lubricant for chuck mechanism was evaluated. This product includes mineral oil with a barium complex soap thickener and around 50 wt.-% of solid lubricants (Zinc phosphate, Zinc oxide etc.). As per the technical datasheet, the product has high resistance towards media and water, e.g. against cooling lubricants.

Comparative Example 2

An additional comparative example was also evaluated. More specifically, a commercial white colored product intended for use as lubricant for open gear systems was evaluated. This produced includes mineral and ester oil with an aluminum complex soap thickener and around 20 wt.-% of solid lubricants (Zinc sulfide, Magnesium oxide etc.) and several oil soluble additives (EP/AW, corrosion inhibitor, antioxidants). The product is very tacky and provides excellent water and media resistance.

Comparative Example 3

An additional comparative example was also generated and evaluated as shown below:

| Type of Material | Ingredient | Comparative Example 3 |
|---|---|---|
| Solid Lubricants | Calcium Carbonate | 62.00% |
| | Tricalcium Phosphate/ Hydroxylapatite | 3.00% |
| | Zinc Sulfide | — |
| Adhesion improver | Polyisobutylene Mn = 900-2500 | 7.00% |
| | Ethylene/propylene Copolymer | — |
| Base oils | White Mineral Oil - Highly refined mineral oil (liquid paraffin) | — |
| | Mineral Oil (paraffinic and/or naphthenic base) | 23.00% |
| Thickener | Li-12-Hydroxystearate | — |
| | Zinc Stearate | — |
| Waxes | Beeswax | — |
| | Synthetic Hydrocarbon Wax - Hard paraffinic (non-functionalized) | 5.00% |
| Additives | Corrosion Inhibitor - Semi-ester of succinic acid derivate | — |
| | Total | 100% |

After formulation, the aforementioned Examples and Comparative Examples were evaluated to as follows:

A Schunk Rota S plus 2.0 160-42 manual lathe chuck was lubricated with the sample/comparative being tested and the static clamping force of the chuck was measured. The clamping mechanism of the chuck was moved by using a screw supplied on the side of the chuck. The screw was fitted to an in-house designed adapter which was programmed to tighten the screw (and consequently the chuck) at a speed of 10 revolutions per minute (rpm or sometimes written as 10 l/min) until a torque of 80 Nm was achieved. Once the 80 Nm torque threshold was reached the screw was maintained at that torque for a period of five seconds and then the tightening step was reversed to loosen the chuck at the same speed (10 rpm) to complete a cycle. This process was repeated 100 times, Results with respect to each lubricating grease used following this process were provided in Table 2 below.

TABLE 2

| Ex | Cycle 1 [kN] | Cycle 100 [kN] | Max. [kN] | Min. [kN] | Average [kN] | Clamping Force Drop (%) |
|---|---|---|---|---|---|---|
| 1 | 102.6 | 102.0 | 104.4 | 99.3 | 102.1 | 0.6 |
| 2 | 113.7 | 105.6 | 113.7 | 105.6 | 108.1 | 7.1 |
| 3 | 93.9 | 89.7 | 93.9 | 86.4 | 89.1 | 4.5 |
| 4 | 108.9 | 105.0 | 110.4 | 105.0 | 106.6 | 3.6 |
| 5 | 111.0 | 105.9 | 111.0 | 105.6 | 107.5 | 4.6 |
| 6 | 114.0 | 113.1 | 114.9 | 112.5 | 113.5 | 0.8 |
| Comp 1 | 114.6 | 90.3 | 114.6 | 90.3 | 97.3 | 21.2 |
| Comp 2 | 88.8 | 62.7 | 88.8 | 62.7 | 72.7 | 29.4 |
| Comp 3 | 106.8 | 76.8 | 106.8 | 76.2 | 85.4 | 28.1 |

It is seen from Table 2 that the examples as hereinbefore described all provide significantly smaller clamping force drop than the currently available commercial products used as comparatives. It would appear that this is because the lubricating greases as hereinbefore described provide a significantly better internal lubrication which is retained in/on the metal parts of the chuck and which results in a longer maintenance of clamping forces compared to the commercially available products and as such enable the user to use the chuck for a longer continuous period before the need to re-lubricate the parts.

The inventive composition demonstrates relatively constant clamping forces at a high level compared to reference products.

Physical properties of the greases prepared from the ingredients listed in Table 1 and having the properties indicated in Table 2 have been further assessed in respect of several standard properties of importance for greases and the results are provided in Table 3 below.

Unworked and worked penetration were assessed to determine grease penetration. The optimum grease penetration range for this application is from 265 mm/10 to 340 mm/10 as it has been identified as having the best consistency for the application. This is because the resulting composition is suitable to be used with grease guns whilst also being sufficiently "pasty" to stick on lubricated metal parts. Values outside this range may also be suitable for use as and when appropriate and based on the specific application. The value 60× in the Table indicates that the grease was worked 60 times before measurement. Flow pressure is measured because to determine whether a grease will have sufficient pumpability at temperatures below e.g. −20° C. In this instance a flow pressure of less than 1400 mbar is generally interpreted to mean that there should be an appropriate level of pumpability at such lower temperatures.

Dropping point can be used as an indication of the thermal stability of the lubricating grease composition as described herein. This value needs to be significantly above the working temperature of the clamping device. It is anticipated that clamping devices such as chucks and collets will function up to about 60° C., not least because of the cutting fluid acting as coolant.

Water resistance is an important feature for greases for these applications because the cutting fluids are often water based emulsions. In this application instead of the normal period of three hours used under DIN 51807 pt. 1 it was decided samples were tested for water resistance for a full 24 hours. Cutting fluid resistance was assessed based on DIN 51807 pt. 1 excepting that the tests were undertaken over a 7 day period at room temperature. Three commercially available, water miscible cutting fluids were used in this test. They were used in concentrations of 10% by weight in water but in each case as is seen below the same results were found.

TABLE 3

| | Ex. 1 | Ex. 2 | Ex. 3 | Ex. 4 | Ex. 5 | Ex. 6 | Comp 1 | Comp 2 | Comp 3 |
|---|---|---|---|---|---|---|---|---|---|
| Unworked Penetration, ISO 2137:2007 (en) (mm/10) | 308 | 283 | 306 | 267 | 329 | 289 | — | — | 271 |
| Worked Penetration, ISO 2137 2007 (en) 60x (mm/10) | 314 | 294 | 317 | 290 | 334 | 327 | 250-270* | 265-295* | 264 |
| Density @20° C., DIN 51757:2011-01 (g/ml) | 1.05 | 1.31 | 0.99 | 1.32 | 1.02 | 1.09 | 1.44* | 1.05* | 1.53 |
| Flow Pressure @−20° C., DIN 51805-2:2016-09 (mbar) | 275 | 800 | 375 | 1075 | 550 | 550 | n.m. | n.m. | 500 |
| Dropping Point, Energy Institute IP 396/02, 10K/min (° C.) | 190 | 147 | <140 | 202 | 190 | 232 | n.m. | >180* | No drop point |

TABLE 3-continued

| | Ex. 1 | Ex. 2 | Ex. 3 | Ex. 4 | Ex. 5 | Ex. 6 | Comp 1 | Comp 2 | Comp 3 |
|---|---|---|---|---|---|---|---|---|---|
| Water Resistance, 24 h/90° C., DIN 51807 pt, 1 | 0-90 | 0-90 | 0-90 | 0-90 | 0-90 | 0-90 | n.m. | n.m. | 0-90 |
| Cutting fluid resistance, tested for a 7 day period at room temperature with 3 different commercial cutting fluids, on basis of DIN 51807 pt, 1 | 0-25 | 0-25 | 1-25 | 0-25 | 0-25 | 0-25 | 1-25 | n.m. | 0-25 |

*Data gathered from technical datasheets or safety datasheets.

When combining claimed materials solid lubricants, adhesion improver, base oils, thickener, waxes and optional further additives, as shown for examples 1-6, a product for the lubrication of lathe chuck mechanisms can be created. The goal is to achieve a high and stable level of clamping forces to ensure proper clamping of workpieces. Higher clamping force contribute to improved security against workpiece ejection during service. Stability of clamping force level is important to ensure continued service. As can be seen from the results above, a suitable combination of the aforementioned materials, enables to achieve the desired function of the chuck.

Within this material combination and under certain limits, clamping forces remain on a desired level. If the amount of solid lubricants is reduced, the level of clamping force is reduced, but the stability remains (see Example 3). The product contains more oil and thickener to achieve a pasty consistency. For higher solid lubricants concentration, the concentration of oil and thickener is reduced. As can be seen with Comparative Example 3, which contains significant less amount of base oil and no thickener, the pasty consistency is achieved by the thickening effect of the solid lubricants itself. For Comparative Example 3 the level of clamping force is still high but does not remain stable, as it shows decrease of clamping force in a similar manner as the commercially available products Comparative Example 1 and 2.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration in any way. Rather, the foregoing detailed description will provide those skilled in the art with a convenient road map for implementing an exemplary embodiment. It being understood that various changes may be made in the function and arrangement of elements described in an exemplary embodiment without departing from the scope as set forth in the appended claims.

What is claimed is:

1. A lubricating grease or paste for application on a surface of a device chosen from a keyed chuck device, keyless chuck device, lathe chuck, collet and fastening device, or a mechanism for attaching grinding discs, saw blades, and apparatuses to a drive spindle, said composition consisting of:

a) from about 15 to about 50% by weight of one or more solid lubricant powders chosen from calcium carbonate, tricalcium phosphate, hydroxylapatite, zinc sulfide, and combinations thereof b) from about 34 to about 53% by weight of one or more mineral oils;

c) from about 0.5 to about 20% by weight of one or more adhesion improvers chosen from polyisobutylene having a number average molecular weight (Mn) of from 900 to 2500 g/mol, ethylene/propylene copolymers, and combinations thereof;

d) from about 0.5 to about 3% by weight of one or more waxes chosen from beeswax, synthetic non-functionalized hard paraffinic hydrocarbon wax, and combinations thereof; and e) from about 3 to about 11% by weight of one or more thickeners chosen from Li-12 hydroxystearate, zinc Stearate, and combinations thereof, wherein said lubricating grease or paste exhibits:

an unworked penetration of from about 248 to about 348 mm/10 as measured in accordance with ISO 2137: 2007;

a 60× worked penetration of from about 270 to about 354 mm/10 as measured in accordance with ISO 2137: 2007;

a density of from about 0.99 to about 1.32 g/ml 10 as measured at 20° C. in accordance with DIN 51757: 2011-01;

a flow pressure of from about 2775 to about 1075 mbar as measured at −20° C. in accordance with DIN 51805-2:2016-09;

a dropping point of from about 140 to about 232° C. as measured in accordance with Energy Institute IP 396/02, 10 K/min;

a water resistance of at least zero as measured for 24 hours at 90° C. in accordance with DIN 51807 pt. 1; and a cutting fluid resistance of at least zero as measured over a 7 day period at room temperature in accordance with DIN 51807 pt. 1; and wherein the lubricating grease or paste produces a static clamping force drop of from about 0.6 to about 7.1% when applied to a manual lathe chuck.

2. The lubricating composition of claim 1 wherein the adhesion improver comprises the ethylene/propylene copolymer.

3. The lubricating composition of claim 1 wherein the adhesion improver is the ethylene/propylene copolymer.

4. The lubricating composition of claim 1 wherein the adhesion improver comprises the polyisobutylene.

5. The lubricating composition of claim 1 wherein the adhesion improver is the polyisobutylene.

6. The lubricating grease or paste of claim 1 wherein the one or more solid lubricant powders comprises a first, second, and third solid lubricant wherein:

the first solid lubricant is calcium carbonate;

the second solid lubricant is tricalcium phosphate or hydroxyl apatite; and the third solid lubricant is zinc sulfide.

7. The lubricating grease or paste of claim 1 wherein the one or more solid lubricant powders comprises a first, second, and third solid lubricant and wherein the lubricating grease or paste comprises:

about 5 to about 42 weight percent of the first solid lubricant;

about 3.9 to about 15.5 weight percent of the second solid lubricant; and about 0 to about 2.85 weight percent of the third solid lubricant.

8. The lubricating grease or paste of claim 7 wherein:

the first solid lubricant is calcium carbonate;

the second solid lubricant is tricalcium phosphate or hydroxyl apatite; and the third solid lubricant is zinc sulfide.

9. The lubricating grease or paste of claim 1 wherein the device is chosen from the keyed chuck device, keyless chuck device, lathe chuck, collet and the fastening device.

10. The lubricating grease or paste of claim 1 wherein the device is the mechanism for attaching grinding discs, saw blades, and apparatuses to a drive spindle.

11. The lubricating grease or paste of claim 1 wherein the one or more solid lubricant powders comprises the calcium carbonate.

12. The lubricating grease or paste of claim 1 wherein the one or more solid lubricant powders comprises the tricalcium phosphate.

13. The lubricating grease or paste of claim 1 wherein the one or more solid lubricant powders comprises the hydroxylapatite.

14. The lubricating grease or paste of claim 1 wherein the one or more solid lubricant powders comprises the zinc sulfide.

15. The lubricating grease or paste of claim 1 wherein the one or more solid lubricant powders comprises a combination of the calcium carbonate, the tricalcium phosphate, the hydroxylapatite, and the zinc sulfide.

16. The lubricating grease or paste of claim 1 wherein the one or more waxes comprises the beeswax.

17. The lubricating grease or paste of claim 1 wherein the one or more waxes comprises the synthetic non-functionalized hard paraffinic hydrocarbon wax.

18. The lubricating grease or paste of claim 1 wherein the one or more waxes comprises a combination of the beeswax and the synthetic non-functionalized hard paraffinic hydrocarbon wax.

19. The lubricating grease or paste of claim 1 wherein the one or more thickeners comprises the Li-12 hydroxystearate.

20. The lubricating grease or paste of claim 1 wherein the one or more thickeners comprises the zinc stearate.

* * * * *